United States Patent [19]

Ruspa

[11] 4,041,573

[45] Aug. 16, 1977

[54] MACHINE FOR COMBING AND GRADING TEXTILE FIBERS

[75] Inventor: Bernardino Ruspa, Cameri (Novara), Italy

[73] Assignee: Sant'Andrea Novara Officine Meccaniche E Fonderie S.p.A., Novara, Italy

[21] Appl. No.: 575,550

[22] Filed: May 7, 1975

[30] Foreign Application Priority Data

June 4, 1974 Italy ..... 68752/74

[51] Int. Cl.[2] ..... D01G 37/00; D01G 19/00; D01G 19/12

[52] U.S. Cl. ..... 19/65 R; 19/122; 19/215

[58] Field of Search ..... 19/115 R, 215, 65 R, 19/221, 122, 123

[56] References Cited

U.S. PATENT DOCUMENTS

| | | | |
|---|---|---|---|
| 1,452,352 | 4/1923 | Balls | 19/215 X |
| 1,697,491 | 1/1929 | Binns et al. | 19/122 |
| 1,932,095 | 10/1933 | Webb | 19/65 R |
| 2,931,070 | 4/1960 | Boer | 19/65 R |
| 2,986,779 | 6/1961 | Letterman | 19/221 X |
| 3,351,984 | 11/1967 | Wheelock | 19/115 R X |

FOREIGN PATENT DOCUMENTS

| | | | |
|---|---|---|---|
| 524,835 | 5/1956 | Canada | 19/122 |
| 230,348 | 1/1911 | Germany | 19/115 R |

*Primary Examiner*—Dorsey Newton
*Attorney, Agent, or Firm*—Sughrue, Rothwell, Mion, Zinn and Macpeak

[57] ABSTRACT

A machine for combing textile fibers prior to spinning, which operates to regroup the fibers in accordance with their length, is described. The machine operates to pull off tufts of fibers from a web or card sliver, to perform a preliminary combing of the fibers, and to deposit the tufts onto a conveyor with the fibers extending transverse the direction of advance and the ends of the fibers which were gripped in order to pull the tuft out of the web all aligned along the direction of advance of the conveyor. Subsequently the conveyor carries the tufts past a plurality of withdrawing devices which are successively nearer the conveyor and which operate to pull off first the longer fibers and subsequently successively shorter fibers. The fibers are subjected to a further combing operation as they are withdrawn from the conveyor.

3 Claims, 13 Drawing Figures

MACHINE FOR COMBING AND GRADING TEXTILE FIBERS

BACKGROUND OF THE INVENTION

The present invention relates to the combing and selection operations which are carried out on textile fibres prior to the spinning operation. The main purpose of combing is to remove from the material, which is generally fed along in the form of a continuous band or web, any impurities, such as dust, and also to remove any very short fibres which may be present.

In the case of organic or natural materials the fibres are usually all of different lengths and the fineness of the fibres is inversely proportional to their length.

Since the commercial value of natural textile fibres depends on, among other things, their length and fineness, it is important to be able to determine these for a given material; the composition of a material is sometimes illustrated by a diagram of the fibres which represents the percentage composition of the material as a function of the length of the fibres.

Such a diagram may be produced manually, or with the use of suitable instruments. Known instruments for this purpose operate by sifting a limited sample of the material under examination; such instruments are not, however, suitable for effecting selection of the fibres for the production of a large quantity of yarn.

In the industrial production of threads on the other hand, it is desirable to be able continuously to select fibres according to their length so that fibres of different lengths can be used for different processes, each process being the most appropriate for fibres of a given length, or relatively narrow range of lengths.

At one time, the operation of selecting the fibres on an industrial scale was effected manually and was completely independent of the actual combing operation. In modern spinning installations a manual selection operation is no longer possible partly due to the considerable complexity of the operation but mostly because of the high economic cost of manual selection. Moreover it has not yet been found possible economically to effect such a selection automatically by machine in such a manner as to collect the fibres within sufficiently narrow ranges of length.

OBJECTS OF THE INVENTION

The object of the present invention is to provide a process by means of which it is possible to carry out automatically a selection of fibres according to length at the same time as the combing operation.

SUMMARY OF THE INVENTION

According to the present invention a machine for combing and selecting textile fibres according to their length, comprises at least one feeder arrangement for the textile fibres in the form of a web, the or each feeder arrangement being of a type, known per se, including a grid and a needle block which are movable with respect to stationary pincers to feed said web incrementally towards an associated pulling-off device located at the outlet end of the or each feeder arrangement and operable to pull from the free end of the web tufts of fibres by gripping one end of the fibres and drawing them out from the free end of the web, means for combing the other ends of the fibres of the tufts as they are pulled from the web, a conveyor onto which the said tufts are placed by the said pulling-off device or devices with their said one ends aligned along a line parallel to the direction of advance of the conveyor, so as to form thereon a mat of fibres of substantially constant thickness, a plurality of selection devices axially spaced along the said conveyor, each selection device comprising means for gripping the said other ends of the fibres of the mat on the conveyor and for withdrawing them transverse the direction of advance of the conveyor, the said selecting devices being spaced successively closer to the said line of alignment of the said one ends of the fibres along the path of the conveyor whereby the longest fibres are withdrawn first and the shortest fibres last.

The advantages of the apparatus of this invention lie in the fact that it is now possible, in one machine, to effect both the combing operation and also continuously to select the fibres according to their length. Apparatus for performing the method of this invention is simple to construct and economic to manufacture, partly due to the fact that the combing and selecting operations are carried out by parts serving to perform the two functions at the same time.

Further characteristics and advantages of the invention will become more apparent from the following particular description, which is provided by way of nonrestrictive example only.

DESCRIPTION OF THE ILLUSTRATED EMBODIMENTS

Figure 2:
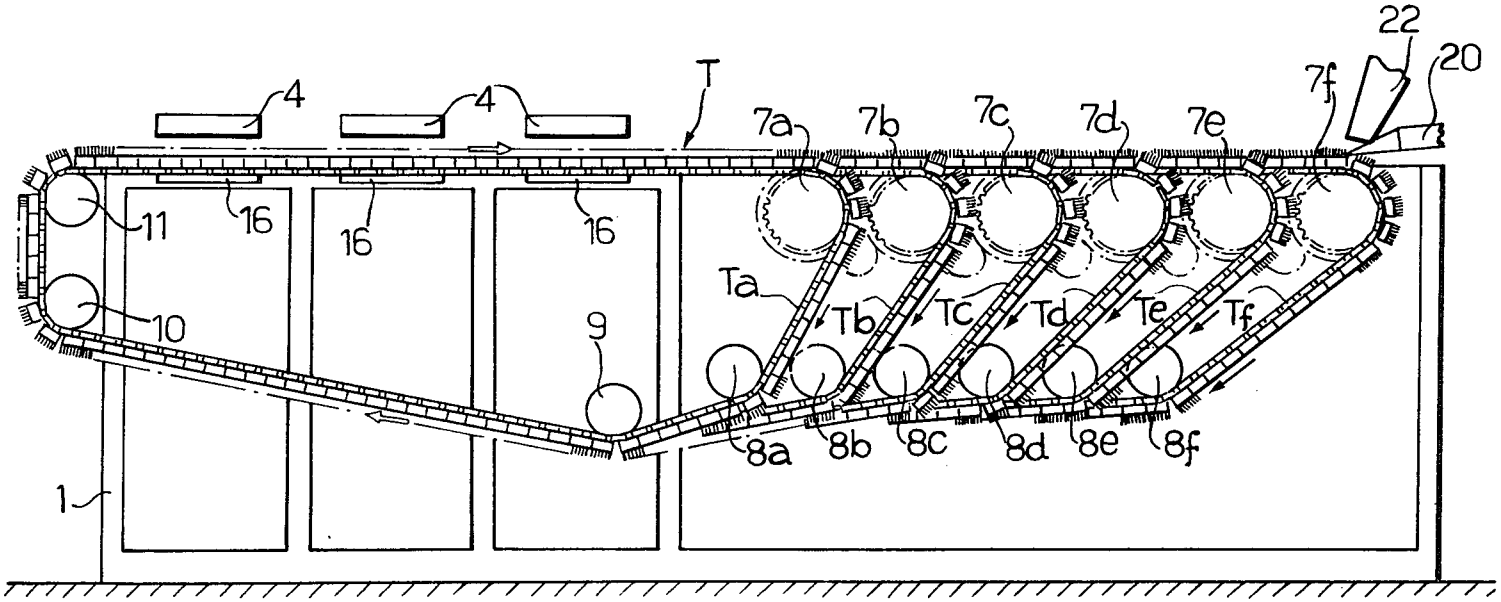
FIG. 2 is a section taken on the line II—II of FIG. 1.
Figure 11:
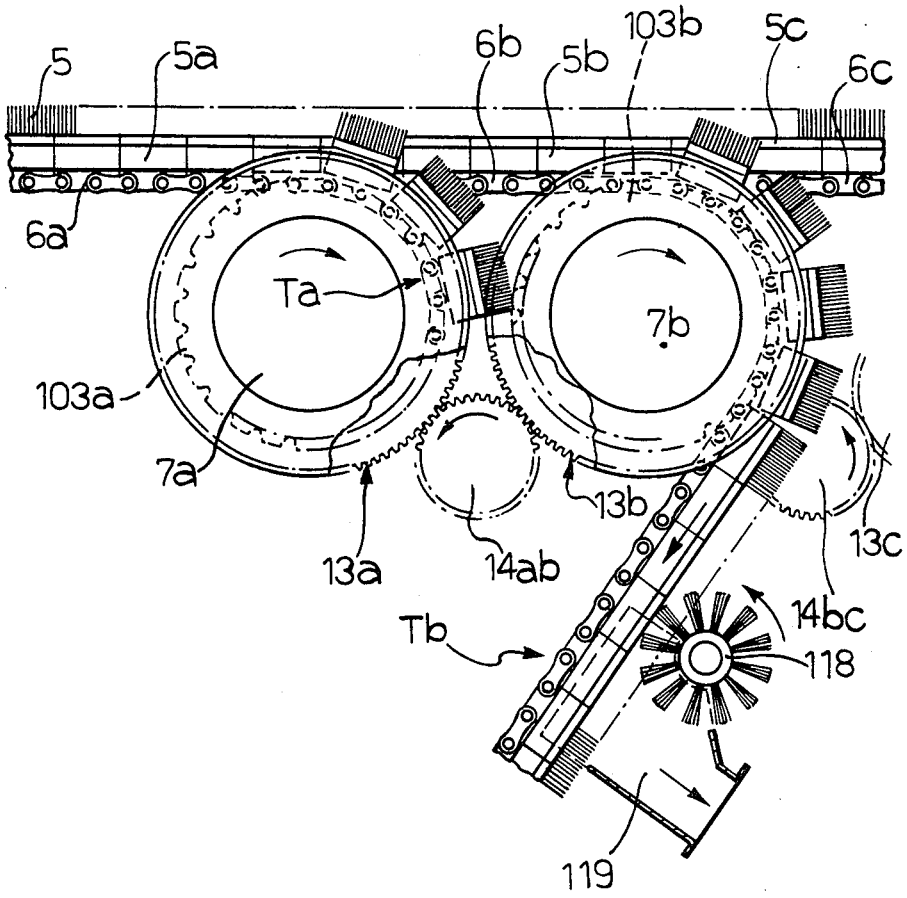
FIG. 11 is a detail, on an enlarged scale, of a part of FIG. 2.
Figure 12:
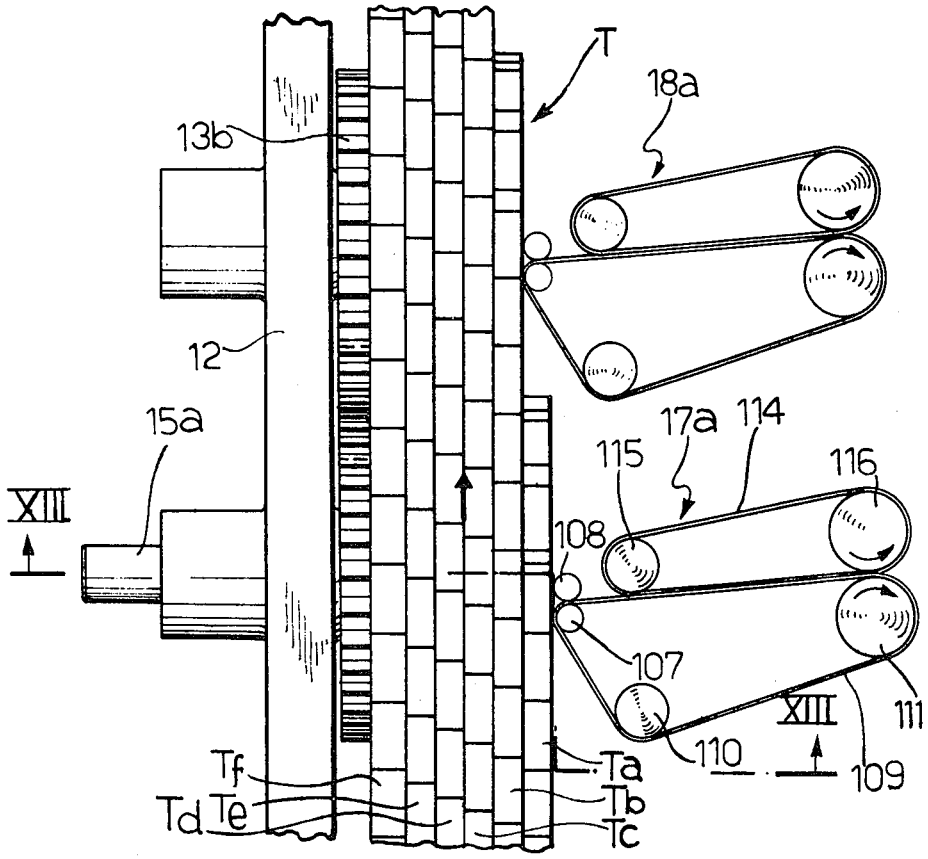
FIG. 12 is a detail, on an enlarged scale, of a part of FIG. 1.

Referring now to the drawings, there is shown a framework generally indicated 1, which supports three feeder devices 3 and facing these, three pulling-off devices 4. Each of the feeder devices 3 feeds on towards a conveyor T a web of textile fibres 2 which are to be subjected to selection and combing operations. The conveyor T is positioned between the feeder devices 3 and the pulling-off devices 4, and comprises six conveyor elements T*a*, T*b*, T*c*, T*d*, T*e*, T*f*. The six conveyor elements are placed side by side and each comprises a loop of chain upon which there are mounted a plurality of small blocks carrying one or more rows of needles 5 in side by side relation. For example, as will be seen from FIG. 11, the conveyor element T*a* comprises a chain 6*a* carrying a plurality of small blocks 5*a*, and the conveyor element T*b* similarly comprises a chain 6*b* carrying a plurality of small blocks 5*b*. The remaining conveyor elements T*c*, T*d*, T*e* and T*f* are formed in a similar manner. As will be seen from FIG. 2 the loops of chain forming the conveyor elements 6 are each carried by four rollers three of which, rollers 9, 10 and 11, are common to all the chains; each chain has an individual drive drum or roller 7*a*, 7*b*, 7*c* 7*d*, 7*e*, 7*f* and an individual jockey roller 8*a*, 8*b*, 8*c*, 8*d*, 8*e*, 8*f* for tensioning the chain. The positions of the rollers are such that each chain 6 has a rectilinear, substantially horizontal upper run. The driving rollers 7 are mounted free to rotate upon pivots carried by a crosspiece 12 which forms part of the framework 1. As seen in FIG. 2, 11 and 12, the rectilinear upper run of each conveyor chain 6 has a different length from that of the others, the length increasing in steps from the conveyor chain T*a* the upper run of which is the shortest, to the conveyor chain T*f* the upper run of which is the longest. The driving roller 7 of each conveyor chain 6 is positioned at one end of the horizontal rectilinear upper run of the associated chain and carries a toothed sprocket which engages the associated conveyor chain. Rotation of the drum 7 transmits forward drive to the associated chain 6, the direction of rotation being such that the upper runs of the chains 6 travel towards the rollers 7 which are spaced longitudinally along the said upper run of the conveyor. FIG. 11 shows, at 103*a*, 103*b* the toothed sprockets of the drums 7*a* and 7*b* which carry the chains 6*a* and 6*b* of the conveyor elements T*a* and T*b*. Each drum 7 extends right across the width of the conveyor T and is provided with a plurality of smooth radial flanges which serve as guides for the chains 6 of the remaining conveyor elements. It will be appreciated that, since the upper runs of the chains 6 are all of different lengths, the width of the conveyor T is different for each of the drums 7. For example, the drum 7*a* has five radial flanges 104*a* to support and guide the chains 6 belonging to the five conveyor elements from T*b* to T*f*. In the same way the driving drum 7*b* of the conveyor element T*b* has a toothed sprocket 103*b* to couple up with the chain 6*b*, and four smooth radial flanges 104*b* each of which supports and guides one of the chains of the conveyor elements T*c* to T*f*. Each driving drum 7 is itself driven through driving gears 13 linked thereto. The abovementioned driving gears 13 are all identical to one another and are coupled together in pairs by transmission gears 14 which are smaller than the driving gears 13. The transmission gear connecting the two driving gears 13*a* and 13*b* is indicated 14*ab* in FIG. 11, and the transmission gear connecting the driving gears 13*b* and 13*c* is similarly indicated 14*bc*.

Figure 1:
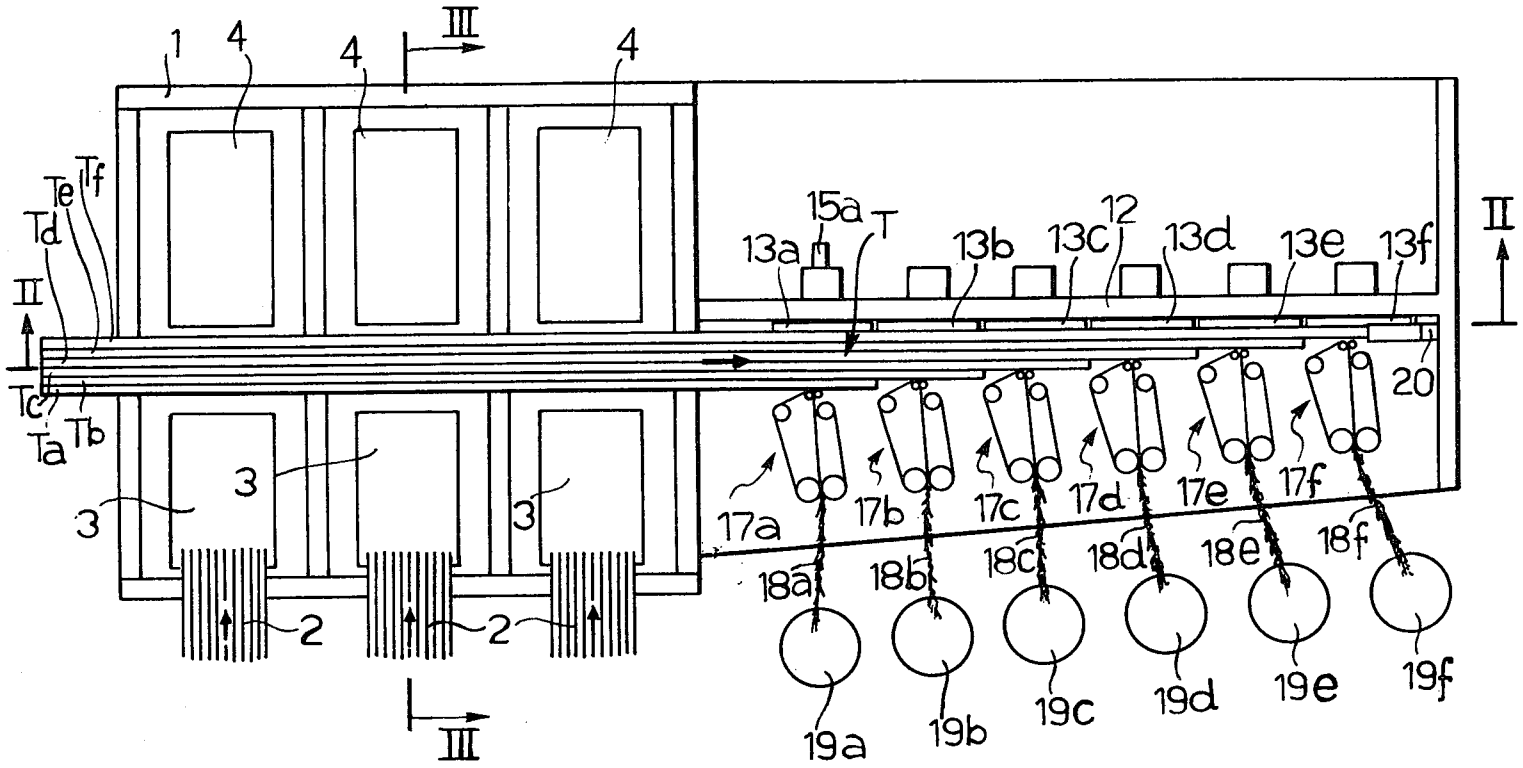
FIG. 1 is a diagrammatic plan view of a machine according to this invention.

The driving drums 7 are thus all coupled together and all rotate at the same speed and in the same direction, thereby causing all the conveyor elements T*a* to T*f* of the conveyor T to move at the same speed. From FIG. 13 it will be seen that the driving drum 7*a* is carried on one end of a spindle 15 which projects through the crosspiece 12 and is supported on bearings 101, 102. The end portion 15*a* of the spindle 15, remote from the driving drum 7*a*, projects out of the crosspiece 12 and is coupled to a driving unit, not shown, by means of which the drive to the whole of the conveyor T is transmitted. The upper runs of the conveyor elements T*a* to T*f* are supported adjacent the pulling-off devices 4 by a fixed guide 16. Each pulling-off device 4 operates to draw out from the web 2, which is fed into position by the corresponding feeder device 3, tufts of textile fibres, and to deposit them cyclically and successively on to the conveyor T, as will be described in greater detail hereinafter, to form a substantially continuous mat of fibres all lying across the conveyor and being transported thereby in a direction transverse their length in the direction indicated by the arrow in FIG. 1. At the end of each conveyor element there is an associated extractor arrangement 17. Each extractor arrangement 17 picks up from the conveyor T, some of the fibres of the mat formed by successive deposition of the tufts by the pulling-off devices 4. The fibres are continuously withdrawn from the mat on the conveyor T by each extractor arrangement and are combined so as to form a roving 18. The extractors 17*a*, 17*b*, 17*c*, 17*d*, 17*e*, and 17*f*, thus act to form rovings 18*a*, 18*b*, 18*c*, 18*d*, 18*e* and 18*f* respectively and these are collected in collection vessels 19*a*, 19*b*, 19*c*, 19*d*, 19*e*, 19*f* respectively.

Figure 5:
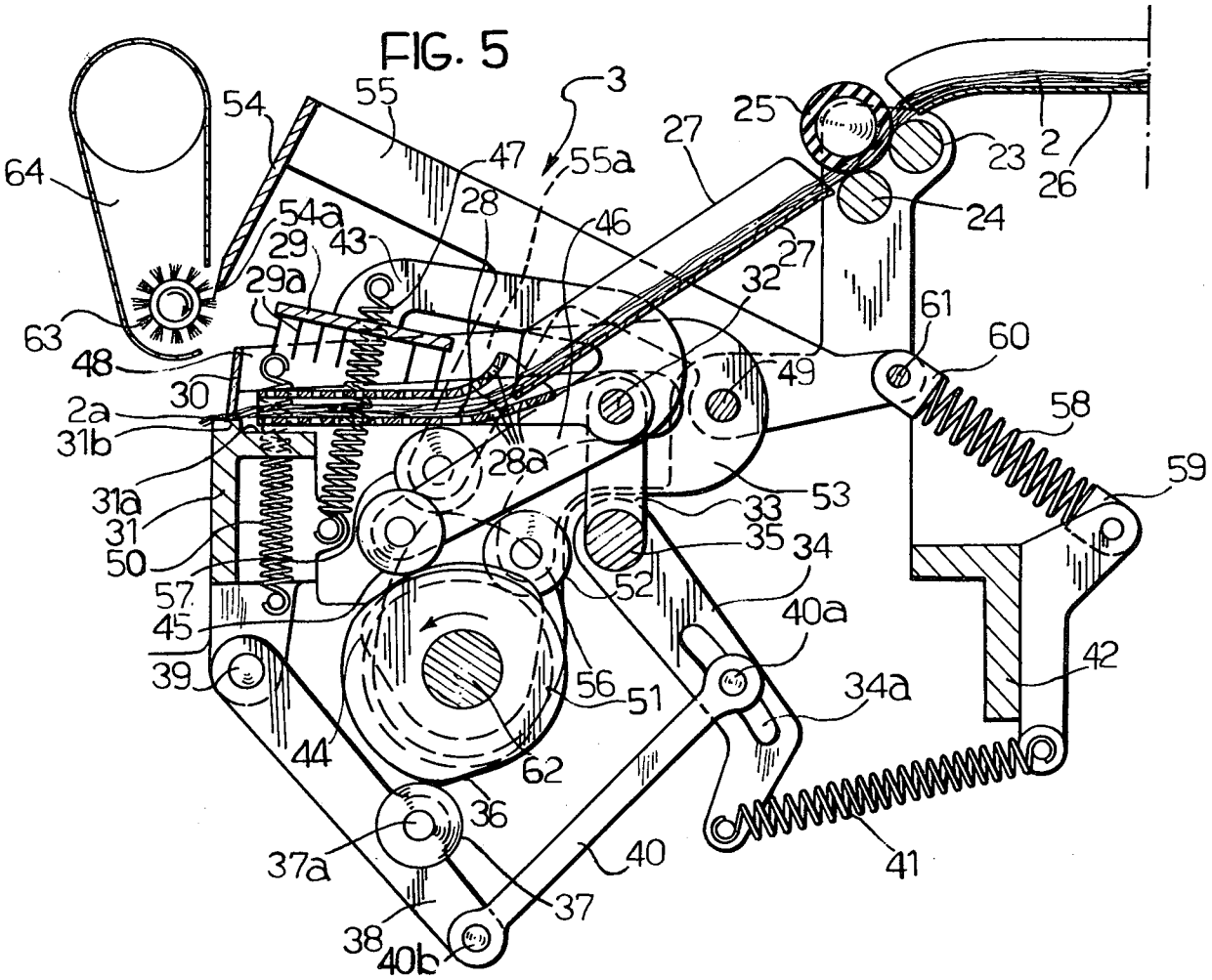
FIG. 5 is a detail, on an enlarged scale, of a part of FIG. 4, showing a feed arrangement of the machine.

With particular reference now to FIG. 5, it will be seen that the web 2, is supported by a table 26, and advanced by a pair of feeder cylinders 23, 24 cooperating with a pressure roller 25. The web 2 then passes on to a chute 27 and from there is taken by the feeder arrangement 3. The feeder arrangement 3 comprises a grid 28 and a cooperating block of needles 29. The grid 28 is supported at the front upon a flat upper surface 31*a* of a crosspiece 31 of the framework 1. The crosspiece 31 constitutes the lower jaw of a fixed pincer arrangement the upper jaw of which is formed by a transverse strip 30 carried on two arms 48 pivoted about a pivot pin 49. The rear portion of the grid 28 is pivoted about a pivot pin 32 which is mounted at one end of a pair of levers 33 which are fixed at the other end to a pivot pin 35, rotatably carried by the framework of the machine. The pivot pin 35 also carries fixed thereto a lever 34 having a longitudinal slot 34*a* therein in which engages a stud 40*a* carried at one end of a drawrod 40 the other end of which is pivoted about a pivot pin 40*b* to one end of a lever 38. The opposite end of the lever 38 is carried by a pivot pin 39 which is mounted on the crosspiece 31. At an intermediate point along its length the lever 38 carries a roller 37 rotatable about a pin 37*a* and engageable with a cam 36 carried by a shaft 62. The shaft 62 is driven to rotate continuously at a constant speed in the direction indicated by the arrow in FIG. 5, by known means (not shown) and is carried by the framework of the machine. The cam 36 impresses a cyclic motion upon the lever 38 and this motion is transmitted through the drawrod 40 to the levers 33 and 34 and thus to the grid 28 which therefore reciprocates longitudinally of the web 2 when the shaft 62 rotates. A tension spring 41 is engaged at one end on a crosspiece 42 of the framework, and at the other end is connected to the lever 34 so as to maintain the roller 37 in contact with the cam 36. The magnitude of the reciprocations of the grid 28 can be varied by adjusting the position of the stud 40*a* in the longitudinal slot 34*a* of the lever 34.

The block of needles 29 is carried by a pair of arms 43 of a pair of cranked levers which are pivoted at their elbows about the pivot pin 32. The cranked levers have two further arms 46 the free ends of which carry a roller 45 which engages a further cam 44 carried by the shaft 62. The block of needles 29 is thus driven with a reciprocating arcuate movement about the pivot pin 32 upon rotation of the shaft 62. The needle block 29 also reciprocates longitudinally of the web 2 with the grid 28 as it is carried by the pivot pin 32 to which the grid block 28 is connected. A tension spring 47 anchored at one end to the crosspiece 31 and at the other end to one of the arms 43 which carry the needle block 29, resiliently biases the needles 29 towards the grid 28. The movements of the block of needles 29 and of the grid 28 are thus synchronized, and are such that whilst the grid 28 moves backwards, that is towards the conveyor 27, the block of needles 29 is raised; as the grid 28 advances on the other hand the needle block 29 is lowered. The needle block 29 is provided with a plurality of needles 29*a* which are positioned so as to penetrate through a plurality of openings 28*a* in the grid 28 when the needle block 29 is lowered. Thus when the needle block 29 is lowered and the grid 28 moves forward the needles 29*a* extend into the web 2 and draw this forward toward the fixed pincer arrangement comprising the jaws 30 and 31*b*. As the grid 28 advances the upper jaw 30 of the fixed pincer arrangement is in the raised position.

The pivot pin 49 which carries the arms 48 of the upper jaw 30 is carried by the framework of the machine. The lower jaw of the fixed pincer arrangement is constituted by a part 31*b* of the crosspiece 31. The upper jaw 30 acts to press a portion 2*a* of the web 2 down on to the lower jaw 31*b* when the pincers are closed. This occurs when the needle block 29 is raised and the grid 28 moves back. The movement of the upper jaw 30 of the fixed pincer arrangement is synchronised with that of the grid 28 and the needle block 29 by means of a further cam 57 carried on the cam shaft 62 against which engages a roller 52; the roller 52 is pivoted on the free end of a lever 53 integrally formed with one of the arms 48. The upper jaw 30 is normally held in the closed position by a tension spring 50 anchored at one end to the crosspiece 31 and at the other end to the arm 48.

Immediately adjacent the upper jaw 30 is a rectilinear comb 54 carried by a pair of arms 55 pivoted to the pivot pin 49. The comb 54 can be raised and lowered by rotation of the arms 55 about the pivot 49, this being obtained by means of a cam 56 carried on the cam shaft 62 and acting on a roller 57 which is rotatably carried on the end of a transverse projection 55*a* extending from an intermediate point of one of the arms 55. The comb 54 is normally held in the lowered position by a compression spring 58 acting, at one end 60, on a pivot pin 61 carried at the end of one of the arms 55 remote from the comb 54. The other end 59 of the spring 58 is carried on a fixed crosspiece 42. The comb 54 has a plurality of needles 54*a* which when the comb 54 is raised away from the web 2, come into contact with the bristles of a rotating brush 63 the action of which is such as to remove from the said needles any dust or other impurities collected upon combing. Such impurities are then removed in a known manner, through a conduit 64.

Figure 3:
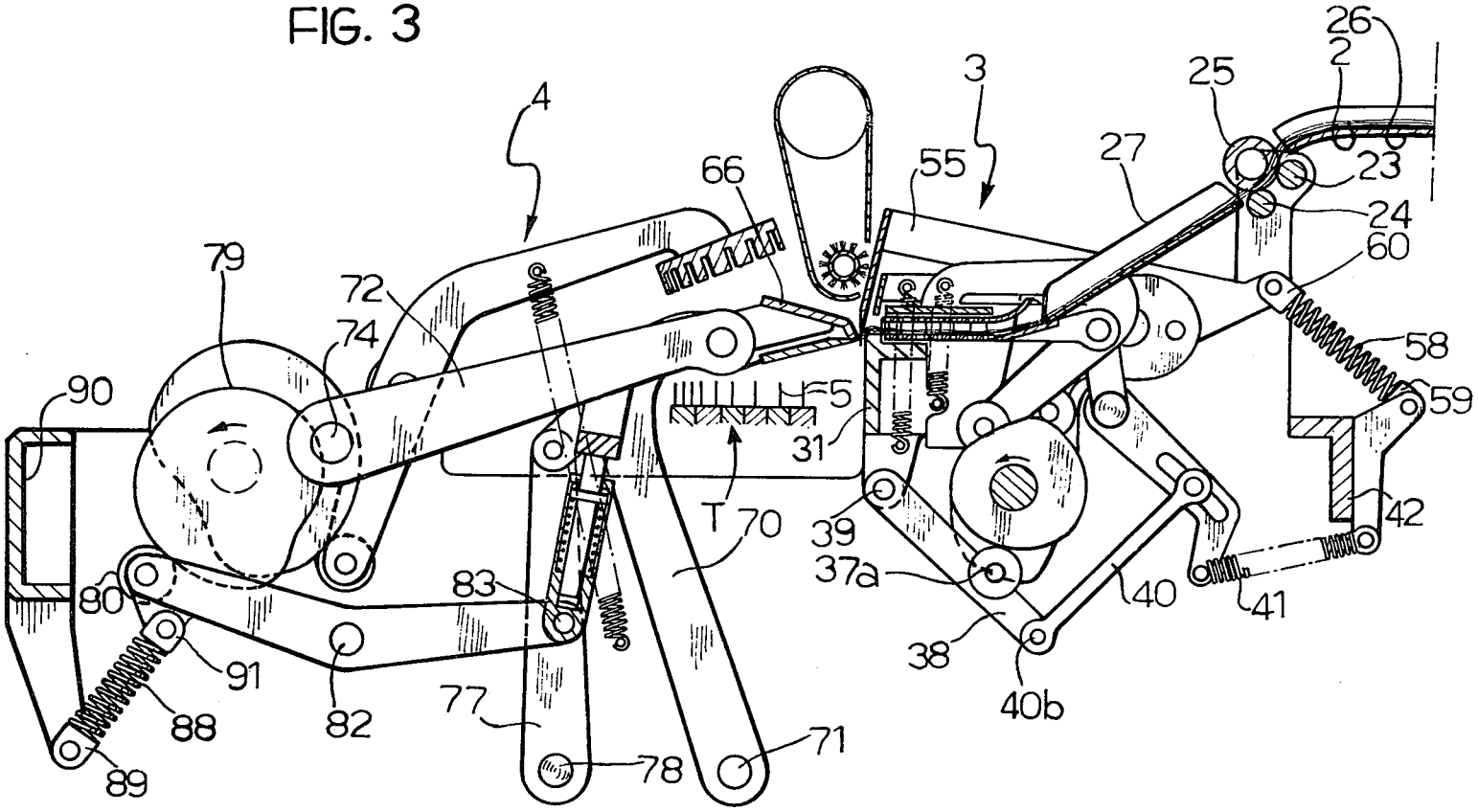
FIGS. 3 and 4 are sections taken on the lines III—III of FIG. 1 and showing the machine in two different stages of its operating cycle.
Figure 4:
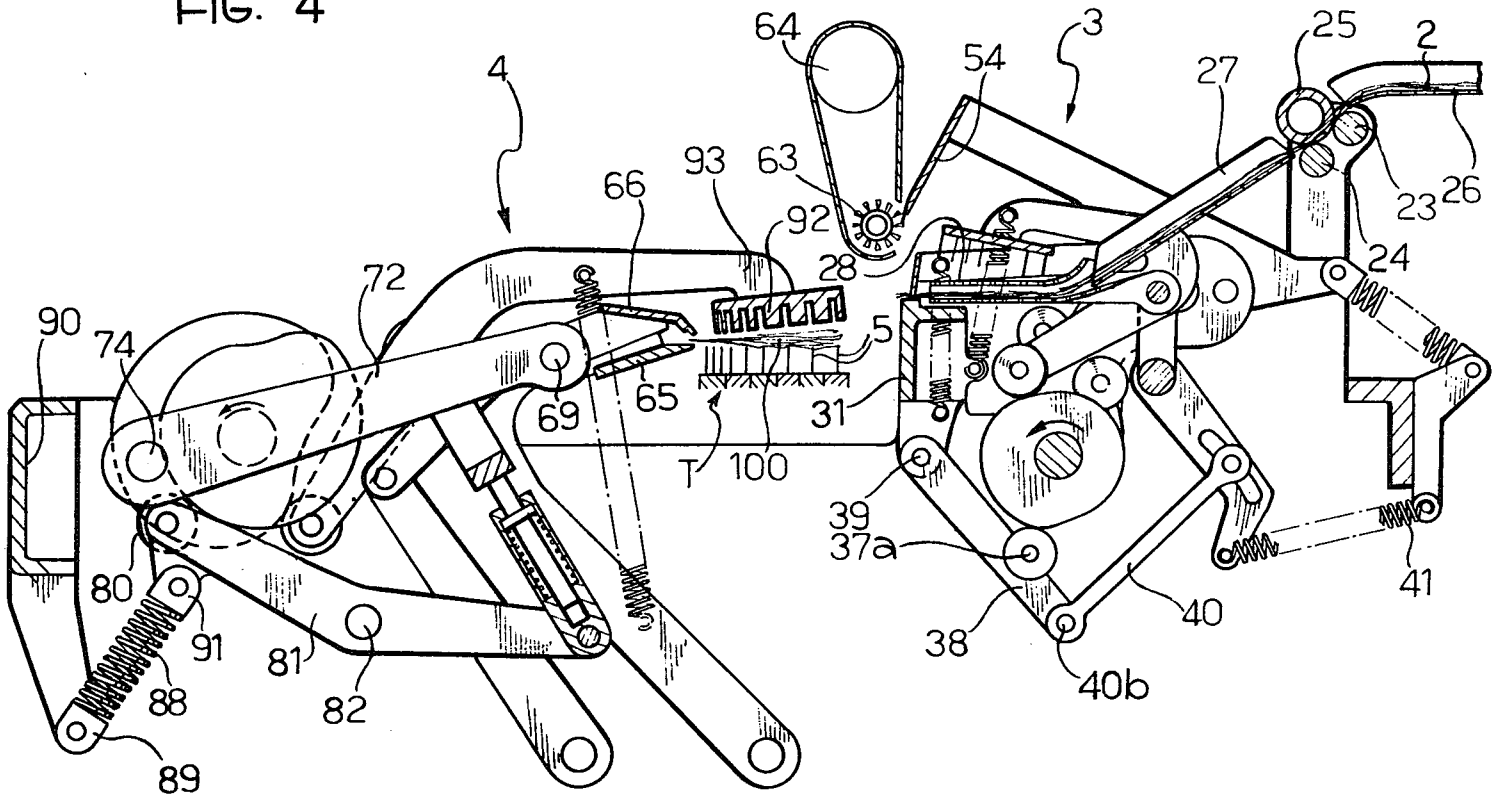
Figure 6:
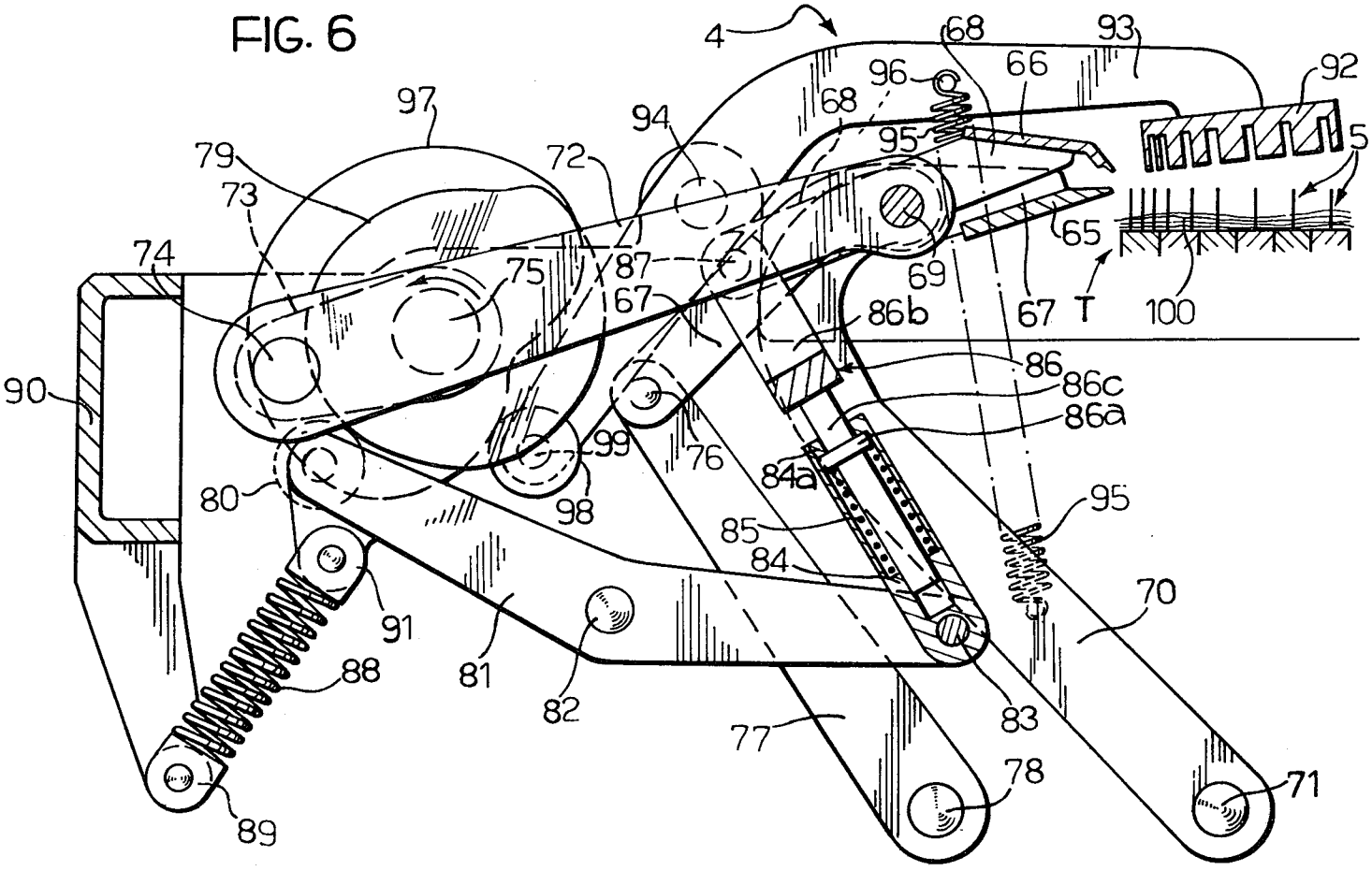
FIG. 6 is a detail, on an enlarged scale, of a part of FIG. 4, showing a pulling-off device of the machine.

FIG. 6 illustrates one of the pulling-off arrangements 4, which comprises a pair of pincers having a lower jaw 65 and an upper jaw 66. These are carried respectively by arms 67 and 68 which are pivoted about a pivot pin 69. The pivot pin 69 is carried by a pair of links 70 which are pivotally mounted on a pivot pin 71 which is fixed to the framework of the machine; to the pivot pin 69 is connected one end of a connecting rod 72. The other end of the connecting rod 72 is pivotally mounted on a stud 74 carried by a crank 73 on a shaft 75 supported by the framework and driven to rotate at a constant speed in the direction indicated by the arrow in FIG. 6. As the shaft 75 rotates the connecting rod 72 imparts to the pivot pin 69, and thus to the pulling-off pincers, a reciprocating movement which, because of the fixed mounting of the links 70 on the pivot pin 71, is arcuate, the highest point of the arc occurring at the position of closest approach of the jaws 65, 66 of the pincers to the feed arrangement 3. The arm 67, supporting the lower jaw 65 of the pincers, is pivoted at the end remote from the jaw 65, to a pivot pin 76 fixed to one end of a pair of parallel links 77 which are pivoted at the opposite end on a fixed pivot pin 78. The arm 68 which carries at one end the upper jaw 66 of the pincers, is pivoted at the opposite end to a pivot pin 87 carried on the free end of the two arms 86*b* of a forked rod 86 the handle 86*c* of which carries a slidable collar 86*a*. The collar 86*a* can slide along a longitudinal channel cut in a rod 84. A compression spring 85 is also housed in the channel in the rod 84 and this biases the collar 86*a* keeping it normally pressed against an aboutment 84*a* at one end of the rod 84. Until the biasing force of the spring 85 is exceeded the rod 86 and the rod 84 behave as a single rigid rod. The rod 84 at the end opposite that carrying the aboutment 84*a*, is pivoted by a pivot pin 83 to one end of a crank lever 81 which is centrally pivoted about a pivot pin 82 fixed to the framework of the machine. At the other end of the crank lever 81 is carried a roller 80 which is engageable with a cam 79 fixed to the shaft 75 which, as mentioned above, is driven to rotate at a constant speed, in the direction indicated by the arrow in FIG. 6, by a known type of drive means, not shown. A compression spring 88 anchored at one end 91 to the lever 81 and at the other end 89 to a crosspiece 90 of the fixed framework of the machine, holds the roller 80 in contact with the associated cam 79 which thus controls, through the linkage described, the motion of the arm 68 carrying the upper jaw 66 of the pulling-off pincers, causing angular reciprocatory movement about the pivot pin 69. In this way the regular opening and closing of the pulling-off pincers is derived; it will be seen, in this respect, that upon closing of the jaws the free end of the upper jaw 66 comes into contact with the corresponding free end of the lower jaw 65; during the movement of the pincers the force on the small collar 86*a* overcomes the resistance of the spring 85, and thus the collar 86*a* is moved away from the abutment 84*a* of the rod 84 so that the resistance of the spring 85 is transferred, through the fork rod 86, to the jaws of the pulling-off pincers, conferring upon the latter the necessary resilience to avoid damage and to ensure a tight grip regardless of the thickness of the tufts gripped thereby. The pulling-off pincers thus reciprocate to and fro and also open and close in a cyclic movement; at each working cycle the pincers grasp the free end of the web 2, when in the position shown in FIG. 3, then move back pulling off a tuft 100 of fibres, and finally deposit the tuft onto the needles 5 on the surface of the conveyor T. This latter stage of the operating cycle is shown in FIG. 4.

The pulling-off device is also furnished with a crusher arrangement 92 which operates to press the tufts 100 down onto the conveyor T causing them to penetrate between the needle 5 so as to form a substantially uniform mat. The crusher arrangement 92 is carried at the end of a pair of arms 92 pivoted at a point midway along their length about a pivot 94 supported on the fixed framework of the machine. The motion of the crusher arrangement 92 is controlled by a roller 98 rotatable about a pivot 99 mounted at the end of the arm 93 remote from the crusher 92 and cooperating with a cam 97 mounted for rotation with the shaft 75.

Figure 7:
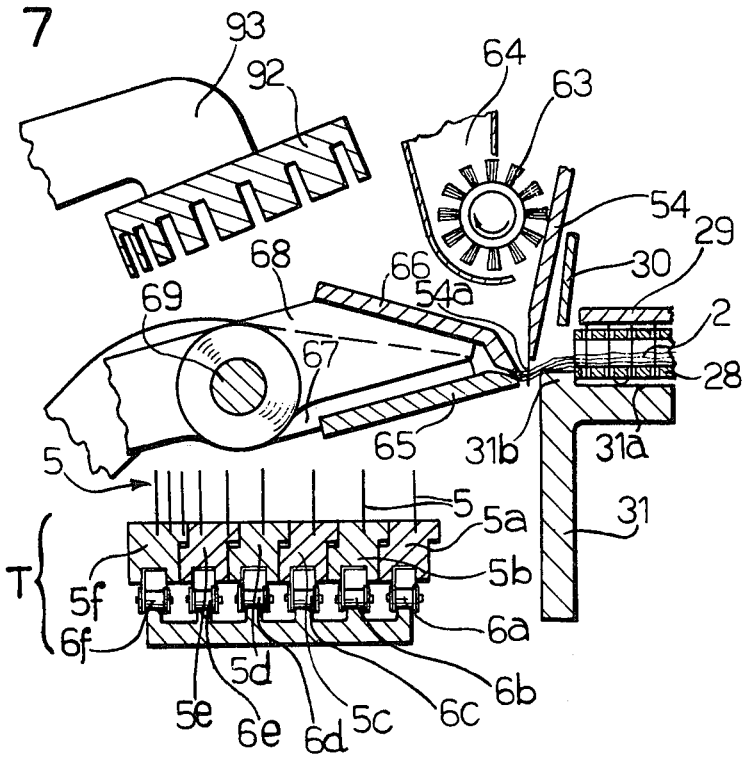
FIGS. 7, 8, 9 and 10 all show a detail of part of FIG. 4 in four different stages of the operating cycle of the machine.
Figure 8:
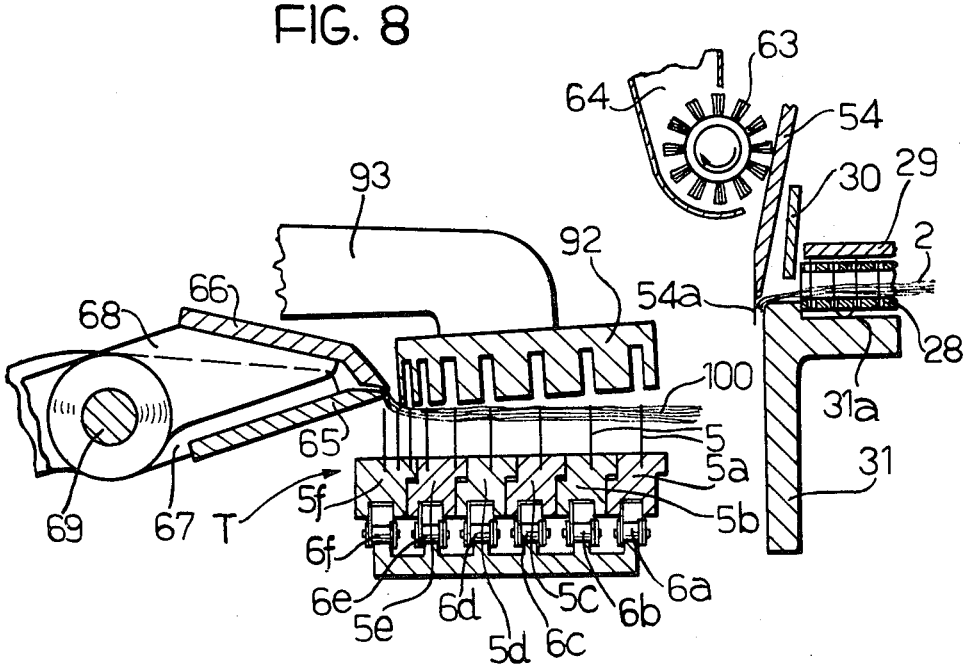
Figure 9:
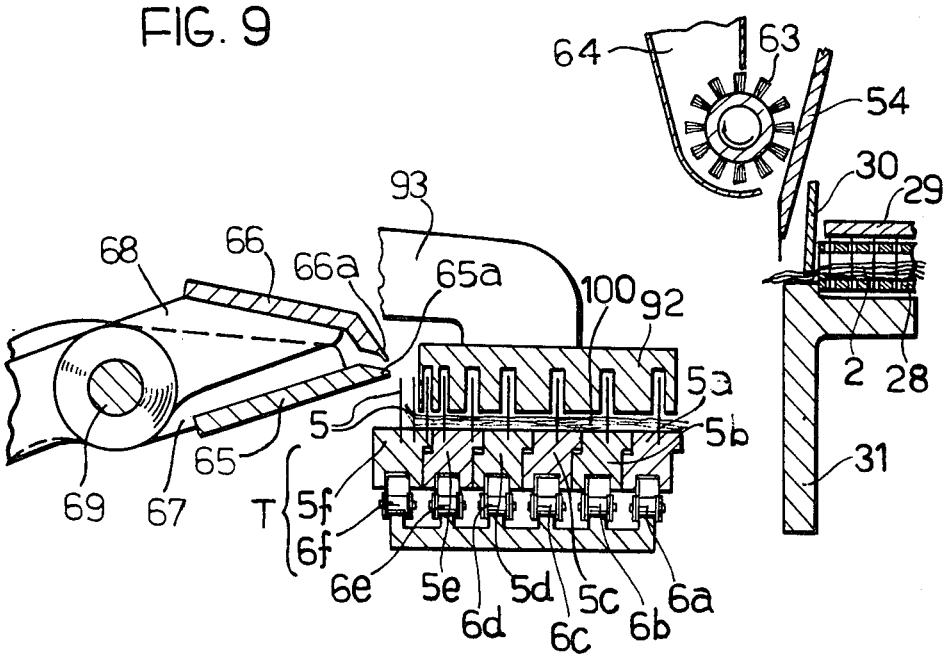
Figure 10:
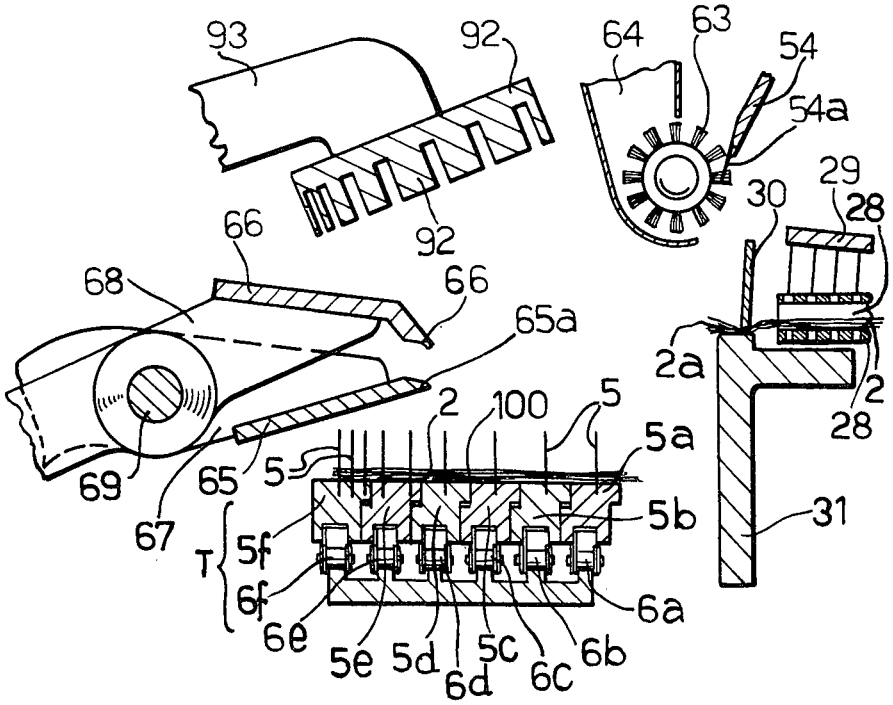
Figure 13:
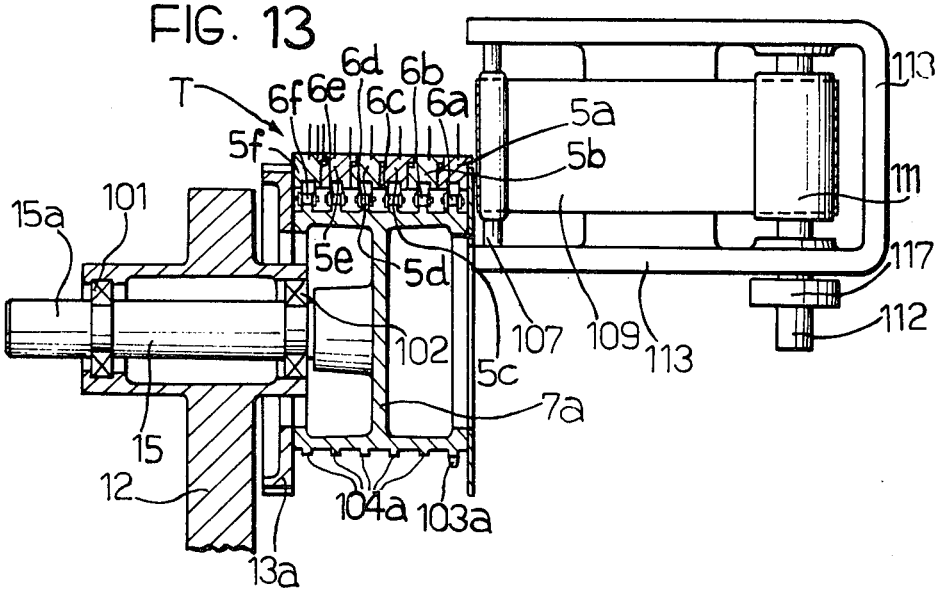
FIG. 13 is a section taken on the line XIII—XIII of FIG. 12.

Each of the components of the feeder arrangement and the pulling-off arrangement has a cyclic motion and these are synchronised in phase with one another by the camshafts 62 and 75. FIGS. 7, 8, 9 and 10 show the relative positions of the various component devices at four different operating stages of the cycle. FIG. 7 shows the start of the pulling-off stage; at this stage the grid 28 is at its most advanced position and the needle block 29 is plunged in to the web 2 which is thus held on the feeder formed by the grid 28 and needle block 29 for movement therewith. The upper jaw 30 of the fixed pincers is raised and the pulling-off pincers comprising the jaws 65, 66 are in the position of closest approach to the feeder arrangement and has just closed on the free edge of the web 2 ready to pull off a tuft of fibres; finally, the needles 54*a* of the rectilinear comb 54 are pressed into the web in close proximity to the pulling-off pincers; the pulling-off pincers then start to move away from the feeder 4, travelling through an arcuate path, as described, to the position shown in FIG. 8. The end of a tuft 100 of fibres gripped by the pulling-off pincers will hereinafter be termed the head end; as the tuft 100 is removed from the web the fibres of the tuft 100, apart from the head end thereof, are combed by the rectilinear comb 54, the tails of the fibres being pulled through the comb 54 by the movement of the pulling-off pincers. In the position shown in FIG. 8 the pulling-off movement is nearly complete. In this position the crusher arrangement 92 is ready to press the drawn off tuft 100 between the needles 5 of the conveyor T, the rectilinear comb 54 starts to rise and the upper jaw 30 of the feeder pincers starts to descend. At the end of this stage of the cycle the components are in the positions shown in FIG. 9. In this position the pulling-off pincers have re-opened, the crusher arrangemet 92 is at its lowermost position, and the rectilinear comb 54 is approaching the top of its travel, whilst the upper jaw 30 of the feed pincers approaches the bottom of its travel. Following this, as shown in FIG. 10, the return stage commences in which the pulling-off pincers, now completely open, are returning towards the feed arrangement, the crusher arrangement, 92, having pressed the tufts 100 onto the conveyor is rising up again, and the rectilinear comb has risen to the top of its travel bringing the ends of the needles 54*a* into contact with the rotating brush 63: the upper jaw 30 of the feed pincers is now completely lowered and presses the free edge 2*a* of the web 2 whilst the needle block 29 is completely raised leaving the web 2 free so that the grid 28 can move away from the free end of the web without dragging the web with it. This sequence of operations forms a mat of fibres on the surface of the conveyor T as a result of the deposition of tufts 100 by the three juxtaposed transfer units each comprising a feed arrangement and a pulling-off arrangement. The mat of fibres is conveyed by the conveyor T towards the six juxtaposed extractor arrangements each placed at the end of the horizontal reectilinear upper arm of a respective conveyor element. These extractor arrangements each operate as selection and combing stations and are identical with one another; an example of their conformation and structure is shown in FIGS. 12 and 13. Each extractor arrangement comprises a pair of extractor cylinders 107, 108, pressed against one another by known means, not shown. Between the cylinder 107, 108 is interposed a flexible belt 109. The extractor cylinders 107, 108 are driven to rotate in opposite directions at a constant speed and cooperate together to grip the tails of fibres of the mat as they pass the nip between the cylinders. The belt 109 also passes over two rollers 110 and 111 and is kept in tension by known means, not shown; the roller 111 is driven from a shaft 112 on which it is carried. The extractor cylinders 107, 108 and the rollers 110 and 111 are supported rotatably by a support structure 113. In contact with the belt 109 and pressed against it by a suitable pressure provided by means of known systems, not shown, is another flexible belt 114 which passes over two rollers 115 and 116. The roller 116 is also supported, free to rotate, by the structure 113 and is driven from the roller 111 through a pair of gears 117 one mounted for rotation with the roller 111 and the other mounted for rotation with the roller 116. The fibres gripped by the tails as they pass the extractor rollers 107, 108 are conveyed between the sleeves 109 and 114, in the form of a roving towards the associated collection vessel 19. Each of the six rovings 18*a*, 18*b* 18*c*, 18*d*18*e*, 18*f* formed by respective extractor arrangements, is made up of fibres the length of which is greater than a respective minimum value, the minimum value of the fibre length of the roving 18*a* being the greatest, and decreasing in steps down to the roving 18*f*.

In order that the rovings obtained may be as constant in diameter as possible, it is important that the mat of fibres on the conveyor be as uniform as possible. For this reason it is necessary to provide at least three transfer units such as those described above and to select the advancement speed of the conveyor T to be within close tolerances.

The machine described is capable of providing, as has been seen, six different rovings each of which is composed of fibres within a respective range of lengths. If it is desired to form rovings having fibres with a wider range of lengths it is only necessary to recombine the appropriate rovings.

Cleansing means are provided for each of the conveyor elements; these take the form of a rotating brush 118 (FIG. 11) and a conduit 119 for sucking away particles or other matter brushed from the conveyor elements. In addition, at the end of the longest conveyor element T*f* there is a multi-bladed comb 20 which penetrates between the needles of the conveyor element T*f* and removes the shortest fibres held thereby, which fibres are too short to be picked up by the extractor arrangement associated therewith; these short fibres are sucked off through a conduit 22 and passed to a collection chamber.

What is claimed is:

1. A machine for grading textile fibers according to their length comprising feeding means for feeding a free end of a web of textile fibers forward in incremental steps including movable jaw means located at a fixed position, movable grid means, a needle block adapted to be inserted into said grid means and means for moving said grid means and said needle block with respect to said jaw means to feed said web incrementally forwards, gripping means for gripping one end of the fibers at the free end of said web and driving means for moving said gripping means to pull from said free end of said web successive tufts of fibers, comb means for combing the other ends of said fibers of said tufts as they are pulled from said web, conveyor means comprising a plurality of conveyor elements positioned side-by-side and disposed substantially perpendicular to the direction of movement of said gripping means, each conveyor element having a form of a closed loop with an upper, rectilinear, substantially horizontal run and a return run, said rectilinear upper run of each conveyor element being longer than that of the adjacent conveyor element on the side thereof nearest to said feeding means, a plurality of parallel rows of needles projecting upwardly from and carried by said conveyor element and means for driving all of said conveyor elements at the same linear speed, said gripping means being releasable to place successive tufts adjacent each other on said conveyor means with one end of each of said tufts being aligned along a line parallel to the direction of advance of said conveyor means and pressing means for pressing said tufts onto said needles so as to form thereon a mat of fibers of substantially constant thickness and a plurality of fiber selection means one of which is placed adjacent the end of the upper run of each of said conveyor elements whereby the longest fibers of said tufts are withdrawn first and the shortest fibers last as they travel along said conveyor means past said fiber selection means and whereby said needles comb said fibers as said fibers are removed from said conveyor means by said fiber selection means.

2. A machine as set forth in claim 1 wherein said comb means is provided with a plurality of needles and is movable between an upper position in which said needles thereof are engaged by a comb cleaning device and a lower position in which said needles thereof are inserted into said web at a position between said movable jaw means and said gripping means.

3. A machine as set forth in claim 1 wherein each of said fiber selection means comprises two cooperating counter-rotating cylinders the axes of which extend perpendicular to the general plane of said conveyor and two cooperating flexible belt means one of which passes through the nip between said two counter-rotating cylinders.

* * * * *